US005788581A

United States Patent [19]

Mabie

[11] Patent Number: 5,788,581

[45] Date of Patent: Aug. 4, 1998

[54] APPARATUS AND METHOD FOR DISPLAYING AN IMAGE INSIDE A GOLF CUP

[76] Inventor: Andrew G. Mabie, 101 Teak Dr., Fredericton, New Brunswick, Canada, E3A 2H9

[21] Appl. No.: 803,233

[22] Filed: Feb. 20, 1997

[51] Int. Cl.[6] ..... A63B 57/00; G09F 3/00

[52] U.S. Cl. ..... 473/175; 40/642.01

[58] Field of Search ..... 40/642.01, 451, 40/642; 473/175–179; 273/288, 290, 156; 434/211, 392

[56] References Cited

U.S. PATENT DOCUMENTS 1,536,716 5/1925 Kade .
2,781,650 2/1957 Lee .
4,437,668 3/1984 Simpson et al. ..... 273/156
4,878,665 11/1989 Boudreau et al. .
4,928,417 5/1990 Boudreau .
5,249,384 10/1993 Dark, Jr. .
5,362,044 11/1994 Hageman .

*Primary Examiner*—Cassandra Davis
*Attorney, Agent, or Firm*—Birch, Stewart, Kolasch & Birch, LLP

[57] ABSTRACT

An image display device and method allow an advertisement or message to be displayed within a golf cup, while permitting the golf cup to maintain sufficient drainage capability. An image carrying member is located between upper and lower members to form a display device which is attached to the bottom wall of a golf cup by prongs extending into the drainage holes of the golf cup. The shape of the display device is readily visible and catches the eye of an observer retrieving a golf ball from within the golf cup.

20 Claims, 3 Drawing Sheets

APPARATUS AND METHOD FOR DISPLAYING AN IMAGE INSIDE A GOLF CUP

BACKGROUND OF THE INVENTION

1. Field of the Invention

The present invention relates to a device and method for displaying an image on the inside of a golf cup. More particularly, the present invention relates to a device and method for displaying an advertisement in the interior portion of a cylindrical golf cup while permitting the golf cup to drain properly.

2. Description of the Background Art

Various golf cup advertising devices are known in the art which have a circular configuration. FIGS. 5 and 6 show prior examples where a circular disk 100 is inserted into a golf cup 102 for displaying an arcuately oriented advertisement 104. The circular disk 100 includes a top disk 106 and a bottom disk 108. A sheet of material 110 is located between the top disk 106 and the bottom disk 108. The arcuately oriented advertisement 104 is printed on a sheet of material 110 such that the advertisement 104 is visible through the top disk 106. A plurality of tabs 112 extend downwardly from the bottom disk 108 for engaging drainage holes 114 in the bottom wall 116 of the golf cup 102. Each of the tabs 112 includes a pointed hook 118 for locking the tab 112 to the bottom wall 116 of the golf cup 102.

A circular flange 120 extends downwardly from an outer edge 122 of the top disk 106. A bottom portion 124 of the circular flange 120 contacts an upper portion 126 of the bottom wall 116 of the golf cup 102. This contact between the bottom portion 124 of the circular flange 120 and the upper portion 126 of the bottom wall 108 extends around the entire circumference of the circular flange 120, and prevents water from properly draining from the golf cup 102 through the drainage holes 114. Instead, water entering the golf cup 102 collects therein until the collected water reaches a height to spill over the upper edge 128 of the top disk 106, traveling along the inclined top surface 130 of the top disk 106 until exiting through the flagstick opening 132. When the flagstick is in opening 132, this drainage could be blocked or at least hindered.

Thus, the background art golf cup advertising device suffers from the drawback that water collecting in the golf cup cannot properly drain, but instead flows over the advertising device which can damage the sheet of material 110, or cause dirt and debris to collect on the inclined top surface 130 of the top disk 106, obscuring the advertisement.

The background art advertising device suffers from a further disadvantage in that once the bottom disk 108 is attached to the bottom wall 116 of the golf cup, by engaging the pointed hooks 118 of the tabs 112 into the drainage holes 114, the bottom disk may only be removed by pulling the entire golf cup 102 out of the ground to release the tabs 112 from engagement with the bottom wall 116 by the use of a screw driver or other prying instrument. This is a time consuming task which is somewhat harmful to the green if performed regularly, because doing so raises the ground making the putting surface uneven and inconsistent.

Finally, the background art advertising device suffers from a further disadvantage in that the advertisement is not readily visible when located within a circular golf cup, and may be easily overlooked. This is because the circular configuration of the disk 100 blends in with the circular configuration of the golf cup 102. Thus, the advertisement 104 in the circular disk 100 may only be visible upon close inspection within the interior of the golf cup 102.

SUMMARY OF THE INVENTION

Accordingly, it is an object of the present invention to provide a device for displaying an image inside of a golf cup which is readily visible and stands out to the observer. More particularly, it is an object of the present invention to provide a substantially square device for displaying an image inside of a cylindrical golf cup such that the square configuration having flat sides is readily perceived by the observer. The substantially square device leaves obvious boundaries when located within the circular golf cup drawing attention to the device and any advertisement or message displayed thereby. A substantially square configuration allows for easier processing of the information contained within its boundaries.

When dealing with visual stimuli, the more simplistic the material being presented, the easier it is for the visual system to process the information. The visual system breaks the units of a configuration down to successfully process it. A square with easily understood units presents the viewer with a precise configuration. A circle on the other hand, is composed of one curve that is not made up of any components, having no distinct beginning or end. Therefore, the processor has nothing to readily break it down into. The distinct features of a square are the four sides and the corners. This draws one's attention to what is being presented within the boundaries of the square configuration.

The boundaries of a square stress the importance of what is contained within them. A message appearing within the square configuration which is printed along a straight line from border to border is more easily and more quickly read than a message arranged arcuately within a circular boundary. Within a circle, the boundaries are not clear, and the beginning and ending points of an arcuate message are confusing. Thus, the processing of arcuately arranged information is dramatically more difficult. Often, when one is presented with something that is remotely difficult to read or quickly process, it will be ignored altogether.

On the other hand, a message arranged within a square configuration tells the reader where the beginning is as well as the ending. This is because readers are familiar with reading by proceeding from left to right across the page from the top of the page toward the bottom of the page as one proceeds from one line of text to the next. The square configuration of the present apparatus allows such dynamics to be easily observed.

Accordingly, it is an object to provide a device for displaying a printed image inside a golf cup having a plurality of drainage holes therein. The device includes an upper member having a substantially square configuration formed by four sides of substantially equal length. A aperture is located in the upper member approximately centrally within the substantially square configuration. A lower member is provided having a substantially square configuration formed by four sides of substantially equal length. The lower member includes a support surface for receiving an image carrying member. An aperture is located in the lower member approximately centrally within the substantially square configuration of the lower member. The upper member is connectable with the lower member for securing the image carrying member therebetween.

It is a further object of the present invention to provide an apparatus for displaying an image inside of a golf cup which allows the golf cup to maintain its drainage capabilities and to keep the displayed image looking fresh and clean. This object is achieved by utilizing a substantially square configuration which allows portions of drainage holes located in the bottom of the golf cup to remain uncovered by the device so that there is sufficient drainage capability maintained within the golf cup.

Thus, it is a further object to provide a device for displaying a printed image inside a golf cup having a plurality of drainage holes therein, the device including a display member having a plurality of corners. Each of the corners is intersected by an imaginary circle encircling the display member. Means for draining fluid from above the display member are provided, the means for draining comprising sides of the display member between the corners thereof being spaced from and out of contact with the circle.

Moreover, this object is provided by a method of draining a golf cup and providing a message in the golf cup, the golf cup having drainage holes therein, the method including the steps of: providing a message carrying substrate having a plurality of corners, with sides of the message carrying substrate extending between the corners; providing a message on the substrate; inserting the message carrying substrate into the golf cup; and orienting the sides of the substrate from ends of the drainage holes during the step of inserting such that an unobstructed direct access opening is provided to the drainage holes, whereby liquid can freely flow from an interior of the golf cup past the sides of the message carrying substrate and into the drainage holes.

It is yet another object of the present invention to provide an apparatus for displaying an image inside of a golf cup which can be easily removed from the golf cup in order to replace the image displayed by the device. This object is achieved by utilizing projecting prongs which include a curved protuberance thereon. The projecting prongs have sufficient capability to hold the display apparatus within the golf cup during normal usage, while at the same time allowing the display apparatus to be removed by simply reaching into the golf cup and dislodging the display apparatus from the bottom wall of the golf cup.

The square shape of the display apparatus provides a further advantage in that a clearance is formed between the side edges of the display apparatus and the interior of the golf cup. This allows a user to easily grip the side edges of the display device in order to apply pressure thereto to place the display apparatus in the golf cup or remove the display apparatus from the golf cup.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
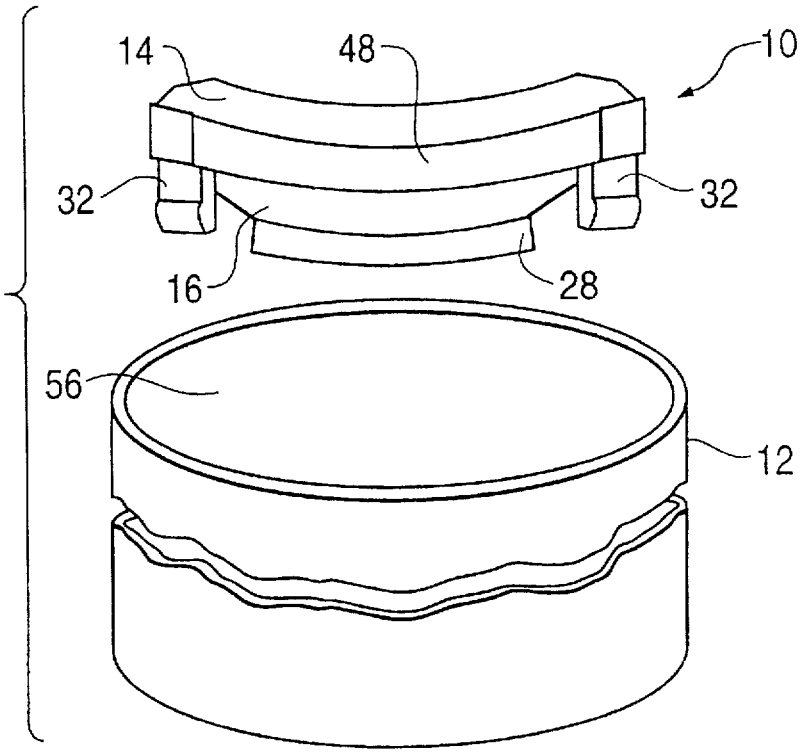
FIG. 1 is a perspective view of the display apparatus for Location within the golf cup.
Figure 3:
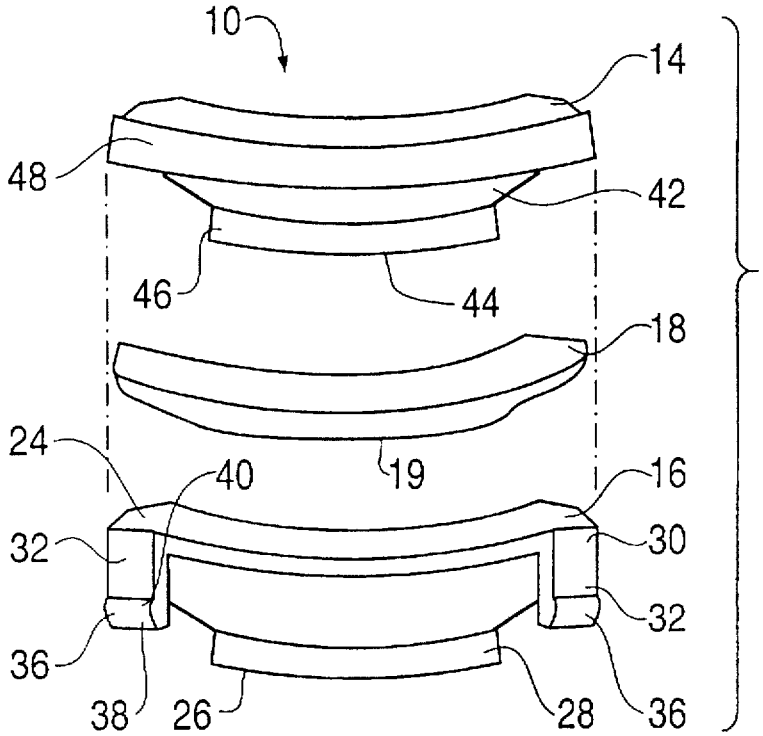
FIG. 3 is an exploded perspective view of the display apparatus.

Referring in detail to the drawings and with particular reference to FIGS. 1 and 3, a display device 10 for displaying a printed image inside of a golf cup 12 is shown. The individual components which make up the display device 10 are more clearly shown in FIG. 3.

Figure 2:
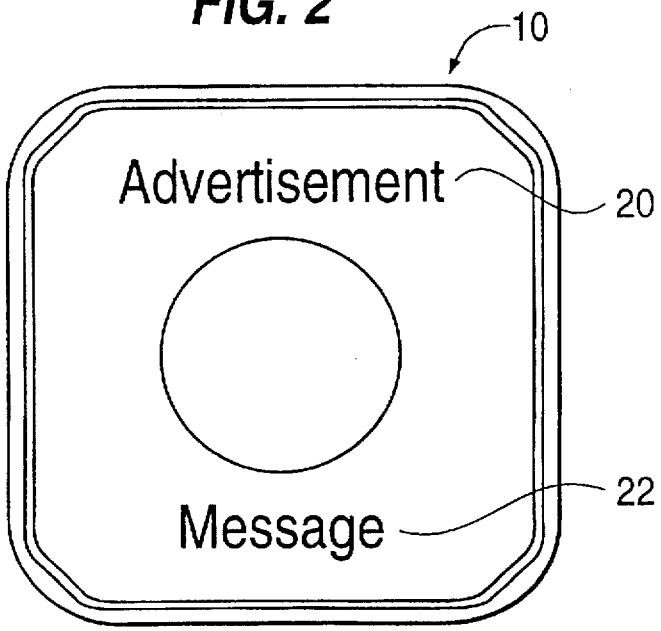
FIG. 2 is a top view of the display apparatus showing the substantially square configuration and an advertisement or message located therein.

The display device 10 includes an upper member 14 and a lower member 16. Between the upper member 14 and the lower member 16, an image carrying member 18 is received. The image carrying member 18 is preferably formed of a paper or cardboard type material, but may also be formed of any material suitable for receiving a printed image thereon, such as plastic. An aperture 19 is formed at the approximate center of the image carrying member 18. As shown in FIG. 2, the printed image may comprise an advertisement 20 or any type of message 22. The upper member 14 is preferably constructed of a transparent material such as clear plastic so that the advertisement 20 or the message 22 may be visible through the upper member 14.

In a preferred embodiment, the upper member 14 and the lower member 16 are formed in a substantially square configuration. The upper member 14 is formed by four sides of substantially equal length. Similarly, the lower member 16 is formed by four sides of substantially equal length. The lower member 16 is formed with a support surface 24 for supporting the image carrying member 18 thereon. The support surface 24 is preferably sloped downwardly and inwardly toward an aperture 26 located approximately centrally within the substantially square configuration of the lower member 16. A flange 28 is formed on a lower portion of the lower member 16 surrounding the aperture 26.

Located on corner portions 30 of the lower member 16 are a plurality of downwardly extending prongs 32 for attaching the lower member 16 to the golf cup 12 by inserting the prongs 32 into drainage holes 34 in the golf cup 12. Each of the prongs 32 has an outwardly directed protuberance 36 at a lower end of the respective prong 32. Each protuberance 36 has a downwardly directed curved portion 38 for facilitating easy installation of the prongs 32 into the drainage holes 34 of the golf cup 12. Each of the protuberances 36 further has an upwardly directed curved portion 40 for facilitating easy removal of the prongs 32 of the lower member 16 from a fixed position within the drainage holes 34 of the golf cup 12.

In order to properly attach the display device 10 to the golf cup 12, it is anticipated that at least two prongs 32 should be formed on the lower member 16. However, any number of prongs 32 may be utilized provided that the desired function of firmly but removably attaching the display device 10 to the golf cup 12 is achieved. In a preferred embodiment, four prongs 32 are located on the lower member 16.

The upper member 14 has a substantially square configuration formed by four sides of substantially equal length in order to correspond to the substantially square configuration of the lower member 16. The upper member 14 includes an inclined top member 42. In a preferred embodiment, the inclined top member 42 is inclined at approximately the same angle as the support surface 24 of the lower member. However, the respective inclination angles may also be different from another.

An aperture 44 is located in the upper member 14 approximately centrally within the substantially square configuration of the upper member 14. A flange 46 surrounds the aperture 44 and extends downwardly from the inclined top member 42 of the upper member 14.

Located adjacent the peripheral edges of the upper member is a downwardly extending lip 48. In a preferred embodiment, the downwardly extending lip extends around the entire perimeter of the upper member. However, the downwardly extending lip 48 may be configured to extend around only a portion of the perimeter of the upper member 14, such as being located only adjacent the corners of the upper member, or only on a portion of two opposing side edges of the upper member 14.

As shown in FIG. 1, the upper member 14 is connectable to the lower member 16 for securing the image carrying member 18 therebetween. When in the assembled condition shown in FIG. 1, the downwardly extending lip 48 of the upper member 14 surrounds peripheral edges of the lower member 16 to fasten the upper member 14 to the lower member 16. At the same time, the flange 46 of the upper member 14 is receivable in the aperture 26 interiorly of the flange 28 of the lower member 16. In this way, the image carrying member 18 is secured between the upper member 14 and the lower member 16, with the downwardly extending lip 48 of the upper member 14 surrounding and enclosing the side edges of the image carrying member 18.

The upper member 14 and the lower member 16 are preferably formed of a plastic material, although any suitable material for this application may be utilized. Although in a preferred embodiment the upper member 14 is completely transparent, the upper member may also have portions which are partially transparent, opaque, translucent, reflective, or any combination of these. In addition, the lower member may be transparent, opaque, translucent, reflective, or any combination of these. Also, the upper member 14 and the lower member 16 may be clear, tinted or colored.

In assembling the display device 10, the image carrying member 18 is placed on the support surface 24 of the lower member 16 such that any advertisement 20 or message 22 faces upwardly. The aperture 19 in the image carrying member 18 is aligned with the aperture 26 in the lower member 16. Thereafter, the upper member 14 is aligned with the lower member 16 such that the flange 46 may pass through the aperture 19 in the image carrying member, and be located within the aperture 26 of the lower member 16. At this time, the downwardly extending lip 48 of the upper member 14 extends down over the side edges of the lower member 16 to enclose the image carrying member 18 therein.

Next, the assembled display device 10 is lowered into the golf cup 12 such that the downwardly extending prongs 32 are received in the drainage holes 34 of the golf cup. A downward pressing force is applied to the upper member 14 such that the downwardly directed curved portions 38 of the prongs 32 engage outermost portions 50 of the drainage holes 34 to slightly deflect the prongs 32 inwardly so that the outwardly directed protuberance 36 may assume an installed position adjacent an underside surface of the bottom wall 52 of the golf cup 12.

To remove a display device 10 which has been installed in a golf cup 12, a user would insert a hand into the golf cup 12 for grasping opposing side edges 54 of the display device 10 and apply an upward force sufficient to cause the upwardly directed curved portions 40 of the protuberance 36 to deflect the prongs 32 inwardly to facilitate disengagement of the prongs 32 from the drainage holes 34. Thereafter, the upper member 14 may be separated from the lower member 16, and the image carrying member 18 removed and a new image carrying member 18 inserted therebetween.

Figure 4:
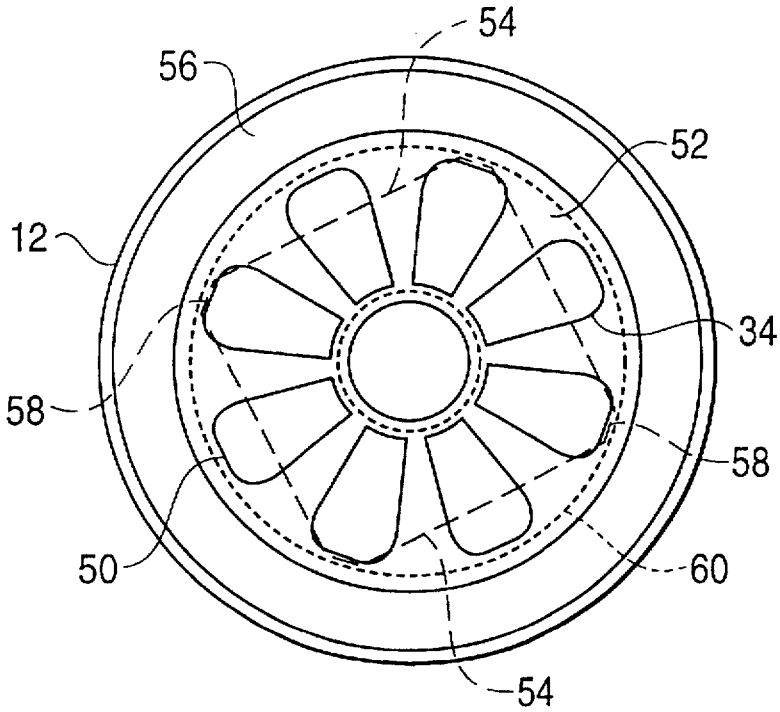
FIG. 4 is a top view of the golf cup showing the display apparatus located therein in dashed lines.
Figure 5:
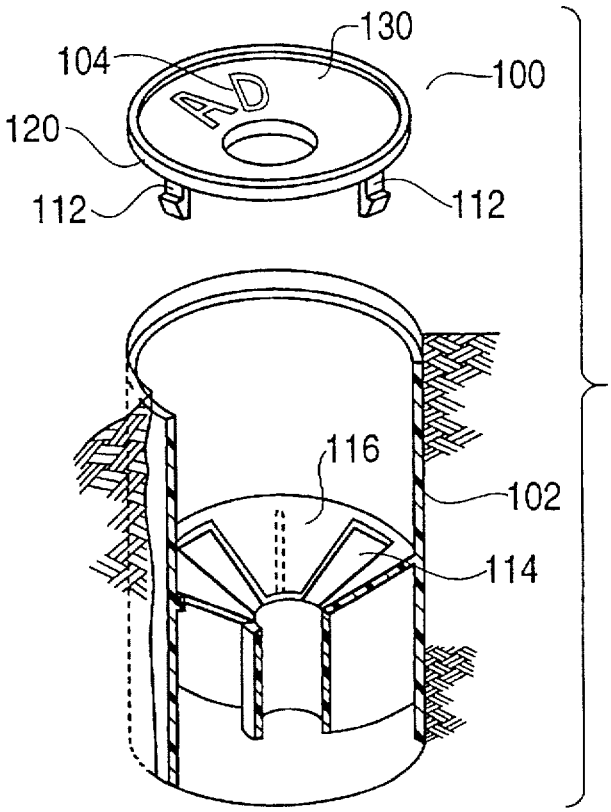
FIG. 5 (PRIOR ART)
FIG. 5 is a perspective view of a circular advertising device of the background art.
Figure 6:
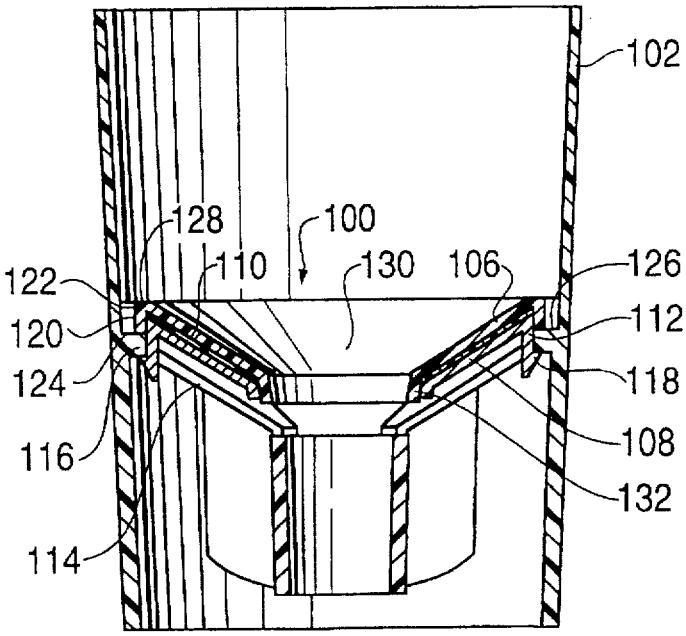
FIG. 6 (PRIOR ART)
FIG. 6 is a sectional view of the circular advertising device of the background art shown in FIG. 5.

As shown in FIG. 4, when the display device 10 is installed within the golf cup 12, the side edges 54 are spaced from an interior side wall 56 of the golf cup 12 such that an unobstructed direct access opening is provided to several of the drainage holes 34. This provides a means for draining fluid from the golf cup 12 which may enter the golf cup 12 from above in the form of rain, ground run-off or various other ways.

As shown in FIG. 4, corners 58 of the display device 10 lie on an imaginary circle 60 encircling the display device 10. Although each of the corners 58 shown in FIG. 4 is intersected by the imaginary circle 60, such is not essential, and additional corners of the display device may be located interiorly of the imaginary circle depending on the particular shape of the display device. The side edges 54 extending between the corners 58 are spaced from and out of contact with the imaginary circle 60, which provides an unobstructed access to certain ones of the drainage holes 34 to allow proper drainage of fluid from the golf cup 12.

The display device 10 allows an advertisement 20 or message 22 to be displayed inside of a golf cup 12 in a manner which is readily visible and stands out to the observer. At the same time, the configuration of the display device 10 allows the golf cup 12 to maintain its drainage capabilities in order to keep the advertisement 20 or message 22 looking clean and directly visible. Finally, the shape of the protuberances 36 on the prongs 32 provides sufficient capability to hold the display device 10 within the golf cup 12 during normal use, while at the same time allowing the display device 10 to be removed by simply reaching into the golf cup 12 and dislodging the display device 10 from the bottom wall 52 of the golf cup 12.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims:

What is claimed is:

1. An apparatus for displaying a printed image comprising:

a cylindrical golf cup having a plurality of drainage holes therein; and a device locatable within said cylindrical golf cup for displaying said printed image inside said cylindrical golf cup, said device comprising:

an upper member having a substantially square configuration formed by four sides of substantially equal length;

an aperture located in said upper member approximately centrally within said substantially square configuration;

a lower member having a substantially square configuration formed by four sides of substantially equal length, said lower member including a support surface for receiving an image carrying member; and an aperture located in said lower member approximately centrally within said substantially square configuration of said lower member;

said upper member being connectable with said lower member for securing said image carrying member therebetween, whereby liquid may drain from an interior of the cylindrical golf cup by passing between said golf cup and said sides of said upper member and into said drainage holes.

2. The device according to claim 1, wherein said upper member further includes a lip extending downwardly from said upper member adjacent a peripheral edge of said upper member.

3. The device according to claim 2, wherein said lip of said upper member surrounds peripheral edges of said lower member to fasten said upper member to said lower member.

4. The device according to claim 1, wherein said support surface of said lower member is inclined downwardly and inwardly from said sides of said lower member toward said aperture in said lower member.

5. The device according to claim 1, wherein said upper member is transparent.

6. The device according to claim 1, wherein said lower member includes a flange extending downwardly from said lower member adjacent said aperture in said lower member.

7. The device according to claim 6, wherein said upper member further includes a flange extending downwardly from said upper member adjacent said aperture in said upper member.

8. The device according to claim 7, wherein said flange of said upper member is receivable in said aperture in said lower member interiorly of said flange on said lower member.

9. The device according to claim 1, further comprising an image carrying member located between said upper member and said lower member.

10. The device according to claim 9, wherein said image carrying member includes a printed advertisement thereon.

11. The device according to claim 1, wherein said lower member further includes at least two prongs extending downwardly from said lower member for fastening said lower member to said drainage holes in said golf cup.

12. The device according to claim 11, wherein each of said prongs has an outwardly directed protuberance at a lower end portion thereof.

13. The device according to claim 12, wherein each said protuberance has an upwardly directed curved portion and a downwardly directed curved portion for facilitating easy removal and installation of said prongs in said drainage holes.

14. An apparatus for displaying a printed image comprising:

a cylindrical golf cup having a plurality of drainage holes therein; and a device locatable within said cylindrical golf cup for displaying said printed image inside said cylindrical golf cup, said device comprising:

a non-circular display member having a plurality of corners and a plurality of sides; and means for releasebly securing the display member to the golf cup means for draining fluid from above the display member, the means for draining comprising said sides of the display member between the corners thereof being spaced from and out of contact with an interior surface of cylindrical golf cup to thereby allow fluid to drain from an interior of the cylindrical golf cup by passing between said golf cup and said sides of said display member and into said drainage holes.

15. The device according to claim 14, wherein said means for draining provides an unobstructed access to the drainage holes.

16. The device according to claim 14, said means for securing further comprising at least one fastener for fastening said device to at least one of said drainage holes in said golf cup.

17. The device according to claim 14, further comprising at least one aperture located in said display member for receiving a flagstick therein.

18. The device according to claim 14, wherein said display member has a substantially square configuration formed by four sides of substantially equal length.

19. A method of draining a cylindrical golf cup and providing a message in the golf cup, the golf cup having drainage holes therein, said method comprising the steps of:

providing a non-circular message carrying substrate having a plurality of corners, with sides of the message carrying substrate extending between the corners;

providing a message on the substrate;

securing the message carrying substrate into the golf cup; and orienting the sides of the substrate from ends of the drainage holes during the step of securing such that an unobstructed direct access opening is provided to the drainage holes, whereby liquid can freely flow from an interior of the golf cup past the sides of the message carrying substrate and into the drainage holes.

20. The method according to claim 19, wherein said orienting step includes locating a portion of at least one of said sides interiorly of an outermost portion of one of said drainage holes.

* * * * *